US008049763B2

(12) United States Patent
Kwak et al.

(10) Patent No.: US 8,049,763 B2
(45) Date of Patent: Nov. 1, 2011

(54) RGB TO RGBW COLOR DECOMPOSITION METHOD AND SYSTEM

(75) Inventors: Young Shin Kwak, Suwon-si (KR); Ju Yong Park, Seoul (KR); Du-Sik Park, Suwon-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 945 days.

(21) Appl. No.: 12/017,395

(22) Filed: Jan. 22, 2008

(65) Prior Publication Data

US 2009/0046307 A1 Feb. 19, 2009

(30) Foreign Application Priority Data

Aug. 13, 2007 (KR) ..... 10-2007-0081229

(51) Int. Cl.
*G09G 5/02* (2006.01)

(52) U.S. Cl. ..... 345/589

(58) Field of Classification Search ..... 345/589–603
See application file for complete search history.

(56) References Cited

U.S. PATENT DOCUMENTS

| | | | | |
|---|---|---|---|---|
| 6,885,380 | B1 * | 4/2005 | Primerano et al. | 345/589 |
| 7,719,715 | B2 * | 5/2010 | Moriya | 358/2.1 |
| 7,859,499 | B2 * | 12/2010 | Furukawa | 345/88 |
| 2006/0139527 | A1 * | 6/2006 | Chang et al. | 349/114 |
| 2009/0002298 | A1 * | 1/2009 | Furukawa | 345/88 |

FOREIGN PATENT DOCUMENTS

| | | | |
|---|---|---|---|
| JP | 10051655 | * | 2/1998 |
| JP | 2001-147666 | | 5/2001 |
| JP | 2006-163069 | | 6/2006 |
| KR | 10-2004-0096273 | | 11/2004 |
| KR | 10-2006-0117025 | | 11/2006 |
| KR | 10-2006-0122882 | | 11/2006 |
| KR | 10-2006-0133194 | | 12/2006 |
| KR | 10-2007-0011830 | | 1/2007 |
| WO | 2006/077554 | | 7/2006 |

OTHER PUBLICATIONS

Spirito, http://latiumsoftware.com/en/articles/00015.php, 2002.*

* cited by examiner

*Primary Examiner* — Ryan R Yang
(74) *Attorney, Agent, or Firm* — Staas & Halsey LLP

(57) ABSTRACT

A Red Green Blue-to-Red Green Blue White (RGB-to-RGBW) color decomposition method and system. The RGB-to-RGBW color decomposition method includes: determining an output value of white based on inputted RGB values and a saturation; and outputting the output value when an input color is a pure color.

43 Claims, 11 Drawing Sheets

RGB TO RGBW COLOR DECOMPOSITION METHOD AND SYSTEM

CROSS-REFERENCE TO RELATED APPLICATION

This application claims the benefit of Korean Application No. 2007-81229, filed in the Korean Intellectual Property Office on Aug. 13, 2007, the disclosure of which is incorporated herein by reference.

BACKGROUND OF THE INVENTION

1. Field of the Invention

Aspects of the present invention relate to a Red Green Blue to Red Green Blue White (RGB-to-RGBW) color decomposition method and system, and more particularly, to an RGB-to-RGBW color decomposition method and system that can be applied to all displays to express an image using a sub-pixel, for example, a transmission-type display such as a liquid crystal display (LCD), a plasma display panel (PDP), a reflection-type display such as electronic paper (E-Paper), a photo-luminescent system such as an organic light emitting diodes (OLED), and the like.

2. Description of the Related Art

The conventional art includes various methods of extracting a Red Green Blue White (RGBW) signal from a Red Green Blue (RGB) signal. However, the conventional art is generally based on not providing an output value of white in order to maintain a degree of purity of colors having a high degree of purity, that is, the colors where V=1 and S=1 based on an 'HSV' (hue-saturation-value, also referred to as HSB, hue-saturation brightness) value standard. However, since a brightness ratio of primary colors to maximum white of a panel decreases, compared with an existing RGB panel in this case, a color of an entire image is decreased.

SUMMARY OF THE INVENTION

Aspects of the present invention provide a Red Green Blue-to-Red Green Blue White (RGB-to-RGBW) color decomposition method and system in which an output value of white increases as a maximum value of inputted RGB values increases and a saturation of an input color decreases during a process of converting an RGB input signal into an RGBW output signal. Aspects of the present invention also provide an RGB-to-RGBW color decomposition method and system that can solve a picture quality deterioration problem due to reduction of a brightness ratio of a primary color by adding white to pure colors and increasing the brightness ratio of the primary color to white of a monitor.

Aspects of the present invention also provide an RGB-to-RGBW color decomposition method and system that can maximize an effect of increasing a reflectivity of a panel and increasing an output saturation by adding white to a pure color, adding only white to colors in which a saturation decreases from the pure color, increasing digital values of remaining channels after all white is used, and reducing the saturation when the present invention is applied to an RGBW reflection-type display where a partition wall does not exist in a sub-pixel.

According to an aspect of the present invention, a RGB-to-RGBW color decomposition method is provided. The method includes determining an output value of white based on inputted RGB values and a saturation; and outputting the output value. The output value of white may increase as a maximum value of the RGB values increases and a saturation of an input color decreases.

According to another aspect of the present invention, the determining of the output value includes receiving the RGB values and determining a maximum value of the RGB values; calculating the saturation based on a minimum value and the maximum value of the RGB values; and calculating the output value of white based on the maximum value and the saturation.

According to another aspect of the present invention, the calculating of the output value of white includes converting, using a color space conversion, the RGB values into Hue, Saturation, Value (HSV) values; calculating the output value of the RGB values using the HSV values; and calculating the output value of white using a value S and a value V of the HSV values.

According to another aspect of the present invention, the calculating of the output value of white further includes performing linearization of the RGB values; and respectively applying a display gamma to the output value of the RGB values and the output value of white.

According to another aspect of the present invention, a RGB-to-RGBW color decomposition method is provided. The method includes receiving inputted RGB values and determining a maximum value of the RGB values; calculating a saturation based on a minimum value and the maximum value of the RGB values; and calculating an output value of white based on the maximum value and the saturation.

According to still another aspect of the present invention, a RGB-to-RGBW color decomposition method is provided. The method includes converting the RGB values into HSV values using a color space conversion; and calculating an output value of white using a value S and a value V of the HSV values. The RGB-to-RGBW color decomposition method may further include calculating the output value of the RGB values using the HSV values, performing linearization of the RGB values; and applying a display gamma to the output value of the RGB values and the output value of white.

Additional aspects and/or advantages of the invention will be set forth in part in the description which follows and, in part, will be obvious from the description, or may be learned by practice of the invention.

BRIEF DESCRIPTION OF THE DRAWINGS

These and/or other aspects and advantages of the invention will become apparent and more readily appreciated from the following description of the embodiments, taken in conjunction with the accompanying drawings of which.

DETAILED DESCRIPTION OF THE EMBODIMENTS

Figure 1A:
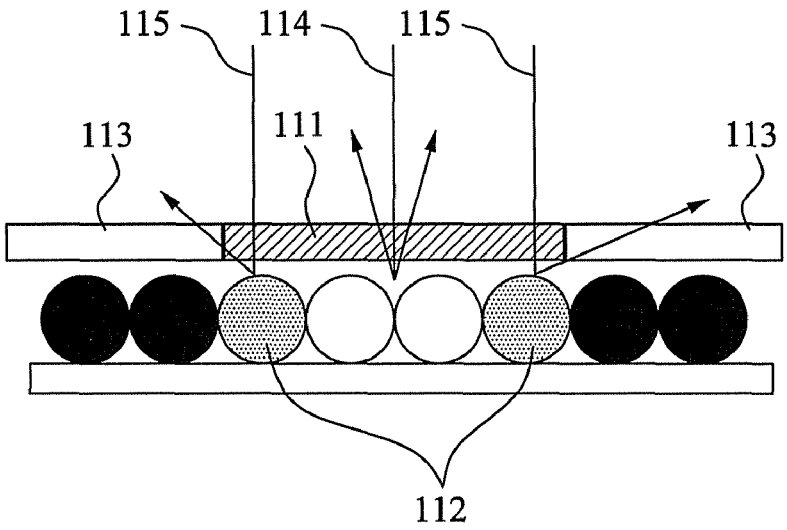
FIG. 1A (RELATED ART)
FIGS. 1A and 1B illustrate a driving of a reflection-type display where a partition wall between sub-pixels does not exist, in a related art.

Reference will now be made in detail to present embodiments of the present invention, examples of which are illustrated in the accompanying drawings, wherein like reference numerals refer to the like elements throughout. The embodiments are described below in order to explain the present invention by referring to the figures.

Figure 1B:
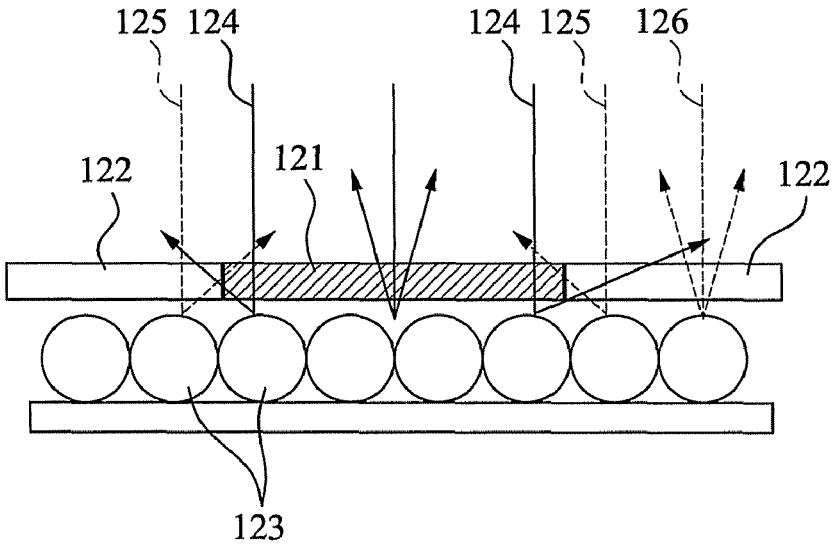
FIG. 1B (RELATED ART)

FIGS. 1A and 1B show a driving of a reflection-type display in a related art where a partition wall between sub-pixels does not exist. The reflection-type display shows a cross-talk between channels greater than an existing liquid crystal display (LCD). Two causes of the cross-talk are described below.

First, cross-talk may be generated because a degree of converting a reflector of a sub-pixel into either white or black is affected by a signal amount of a surrounding sub-pixel when a signal is transmitted to each sub-pixel. As shown in FIG. 1A, when only a red sub-pixel 111 is on, all reflectors of the red sub-pixel 111 cannot be shown as white and are shown mixing with black as the reflectors approach an outer extreme, similar to reflectors 112. Conversely, as shown in FIG. 1B, when both the red sub-pixel 121 and a white sub-pixel 122 are on, all reflectors on a sub-pixel boundary 123 are converted into white. Accordingly, when both the red sub-pixel 121 and a white sub-pixel 122 are both on, a reflectivity shows a value greater than a sum of output reflectivities when the red sub-pixel 121 and the white sub-pixel 122 are both on.

Second, cross-talk can be generated due to scattering generated on a reflector surface as illustrated in light paths shown by arrows in FIGS. 1A and 1B. As shown in FIG. 1A, when the red sub-pixel 111 is on and the white sub-pixel 113 is off, light incident along a first path 114 passes through a red filter of the red sub-pixel 111, is subsequently scattered on the reflector surface, and is mostly transmitted outward through the red filter again. This is recognized by human eyes as a color passing through the red filter twice. Conversely, when light incident along a second path 115 is scattered on the reflector, light is emitted via both the red filter and a white filter of the adjacent white sub-pixel 113. This is shown as a color passing through the red filter once. However, as shown in FIG. 1B, when both the red sub-pixel 121 and the white sub-pixel 122 are on, light paths of a third path 124 incident on the red sub-pixel 121 and passing through the white filter, and a fourth path 125 incident on the white sub-pixel 122 and passing through the red filter, are also recognized as a color passing through the red filter once. Accordingly, when a white signal is added to a red signal, a saturation of red is decreased by light of a fifth path 126 showing white, and an effect of increasing the red signal by the third path 124 and the fourth path 125 is also shown. An effect of decreasing the saturation by the white signal similar to the existing LCD is thus nearly eliminated.

Essentially, when the red (or green, or blue) sub-pixel and the white sub-pixel are adjacent, the reflection-type display having a features shown in FIGS. 1A and 1B show an effect of maintaining the saturation and of increasing a brightness by the two causes described above when the red sub-pixel and the white sub-pixel are on, compared with a brightness when only the red sub-pixel is on. In this instance, when a green (or red, or blue) or blue (or green, or red) sub-pixel is located in the red (or green, or blue) sub-pixel, the reflectivity increases when sub-pixels are simultaneously on, and saturation is not maintained. This results from a fact that when light passing through the red filter passes through a green filter or a blue filter having a high red wavelength range absorption rate, all light is absorbed and the transmitted light is eliminated. When the white signal is appropriately controlled using this physical phenomenon, a brightness reduction phenomenon, compared with white of primary colors, which is a problem in a RGBW system, can be effectively solved.

Aspects of the present invention suggest an RGB-to-RGBW color decomposition method and system of increasing a reflectivity and maintaining a maximum output saturation of the reflection-type display by adding white to a pure color. A pure color here is a color having at least one inputted RGB values being 0 and at least one other values of the inputted RGB value being a maximum value (255 for 24-bit color), such as (0, 255, 255) or (0, 0, 255).

In the RGB-to-RGBW color decomposition process, the output value of white increases as a maximum value of the inputted RGB values, that is, Max(R, G, B), increases and a saturation of an input color decreases. The outputted RGB values may be equal to the inputted RGB values, or may be converted into a new value according to an input color feature and the output value of white. According to an embodiment of the present invention, when the input color is the pure color, the output value of white is outputted, thereby preventing brightness reduction of the pure color, compared with white of a display.

Figure 2:
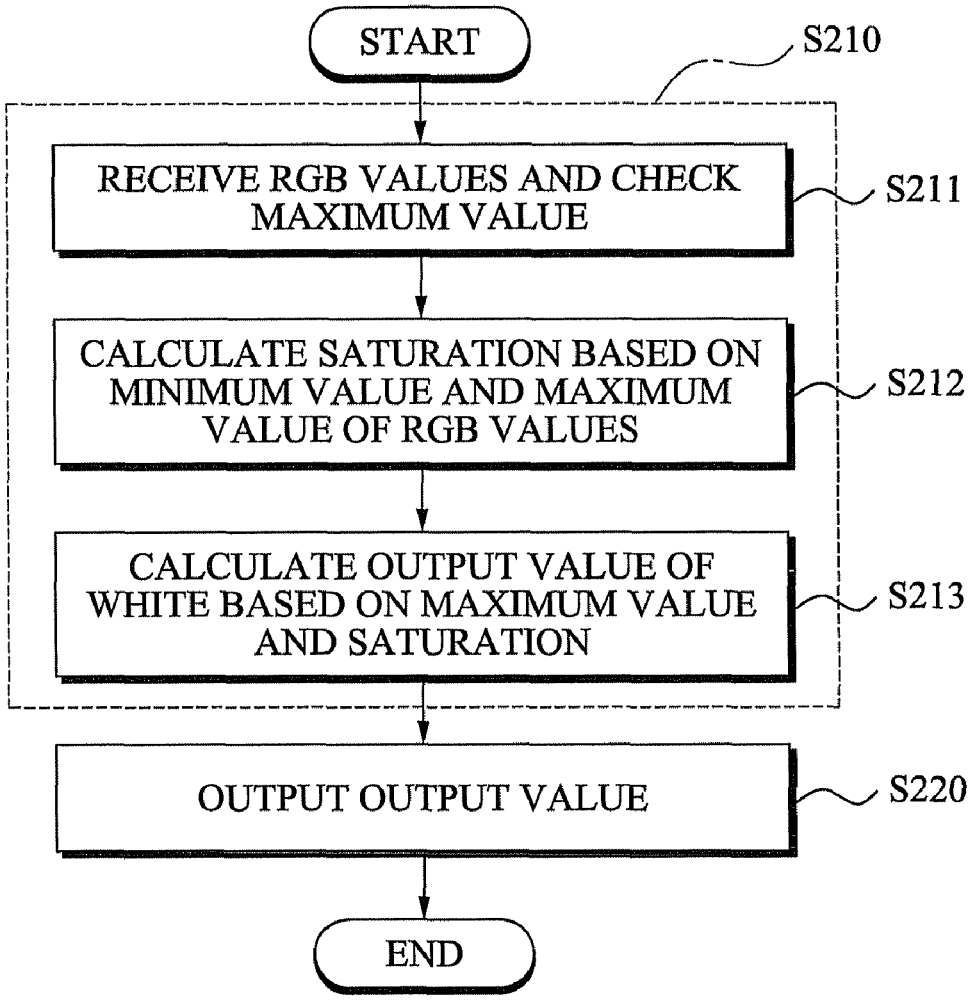
FIG. 2 is a flowchart illustrating a Red Green Blue-to-Red Green Blue White (RGB-to-RGBW) color decomposition method according to an embodiment of the present invention.

FIG. 2 is a flowchart of an RGB-to-RGBW color decomposition process according to an embodiment of the present invention. In operation S210, the RGB-to-RGBW color decomposition system for converting an RGB input signal to an RGBW output signal determines an output value of white based on inputted RGB values and a saturation value. In this instance, the output value of white increases as a maximum value of the RGB values increases and a saturation of an input color decreases. The output value of white may be determined in various ways described in operations S211 through S213 of FIG. 2.

In operation S211, the RGB-to-RGBW color decomposition system receives the RGB values and checks the maximum value. In this instance, the maximum value denotes the maximum value of the RGB values and is shown as Max($R_{in}$, $G_{in}$, $B_{in}$). $R_{in}$ denotes an input value of red, $G_{in}$ denotes an input value of green, and $B_{in}$ denotes an input value of blue.

In operation S212, the RGB-to-RGBW color decomposition system calculates the saturation based on a minimum value and the maximum value of the RGB values. In this instance, the saturation may be shown as S. S may be calculated using the maximum value and the minimum value in accordance with Equation 1:

$$S=\{\mathrm{Max}(R_{in},G_{in},B_{in})-\mathrm{Min}(R_{in},G_{in},B_{in})\}/\mathrm{Max}(R_{in},G_{in},B_{in}), \quad \text{[Equation 1]}$$

where Min($R_{in}$, $G_{in}$, $B_{in}$) denotes a minimum value.

In operation S213, the RGB-to-RGBW color decomposition system calculates the output value of white based on the maximum value and the saturation. The output value of white in accordance with Equation 2 and the RGBW values including the output value of white may be acquired using the RGB values and the saturation, as shown in Equation 2.

$$R_{out}=R_{in},\quad G_{out}=G_{in},\quad B_{out}=B_{in},\quad W_{out}=\{(1-S)(1-\alpha)+\alpha\}*\mathrm{Max}(R_{in},G_{in},B_{in}),\qquad \text{[Equation 2]}$$

where $R_{out}$ denotes an output value of red, $G_{out}$ denotes an output value of green, $B_{out}$ denotes an output value of blue, $W_{out}$ denotes an output value of white, and a denotes a value between 0 and 1. In this instance, the RGB-to-RGBW color decomposition system may control a ratio of mixing the pure color with a white sub-pixel by controlling $\alpha$.

In operation S220, the RGB-to-RGBW color decomposition system outputs the output value of white. When the pure color is inputted as the RGB values, the output value of white may be outputted with each output value of the RGB values.

Figure 3:
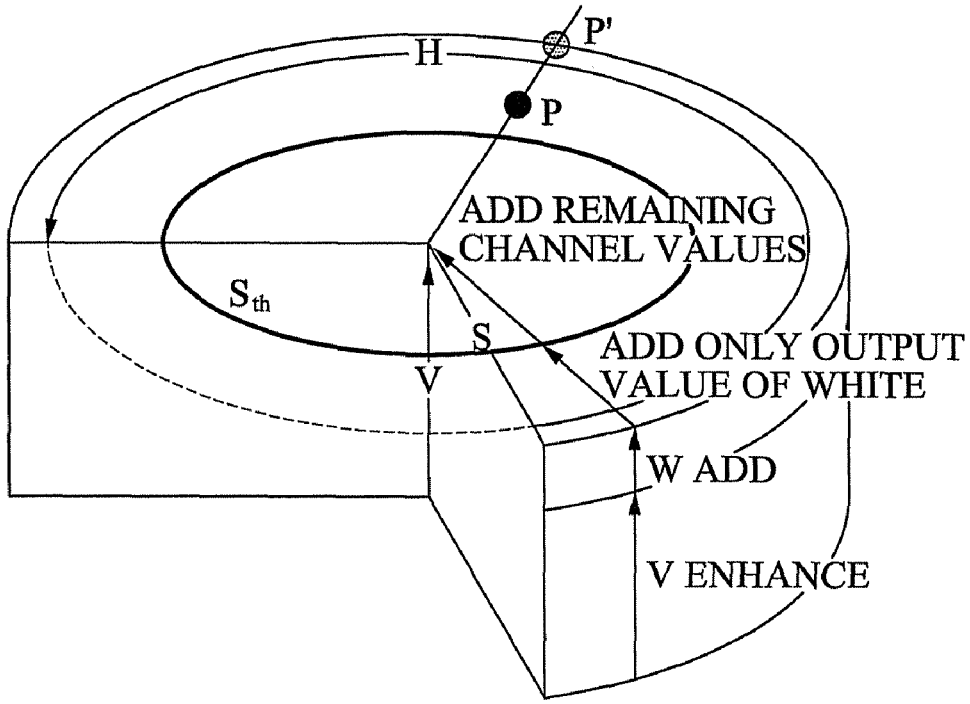
FIG. 3 illustrates a method of calculating an RGBW output signal from an RGB input signal using color space values including a brightness and saturation information according to an embodiment of the present invention.

FIG. 3 illustrates a process of calculating an RGBW output signal from an RGB input signal using color space values including a brightness and saturation information according to an embodiment of the present invention. FIG. 3 uses Hue, Saturation, Value (HSV) values as an example, though other color models, such as CMYK, may be employed as well. HSV is also referred to as HSB, or hue, saturation, brightness, and the two terms are used interchangeably. The HSV values are color space values in accordance with Equation 3 calculated from RGB values. A circular boundary in an upper side of the cylinder shown in FIG. 3 identifies a pure color.

$$H=\begin{cases}\text{undefined}, & \text{if MAX} = \text{MIN}\\ 60\times\dfrac{G-B}{\text{MAX}-\text{MIN}}+0, & \text{if MAX} = R \text{ and } G\geq B\\ 60\times\dfrac{G-B}{\text{MAX}-\text{MIN}}+360, & \text{if MAX} = R \text{ and } G<B\\ 60\times\dfrac{B-R}{\text{MAX}-\text{MIN}}+120, & \text{if MAX} = G\\ 60\times\dfrac{R-G}{\text{MAX}-\text{MIN}}+240, & \text{if MAX} = B\end{cases}\qquad \text{[Equation 3]}$$

$$S=\begin{cases}0, & \text{if MAX} = 0\\ 1-\dfrac{\text{MIN}}{\text{MAX}}, & \text{otherwise}\end{cases}$$

$$V=\text{MAX},$$

where H denotes a hue, MAX denotes a maximum value of RGB values, MIN denotes a minimum value of RGB values, R, G, and B denote values of red, green, and blue of RGB values, S denotes a saturation, and V denotes a value of HSV values determined by a hue and a saturation.

As shown in FIG. 3, the inputted pure color is shown by maintaining the RGB values and adding the output value of white. When the output value of white is entirely shown after increasing only the output value of white to the pure color as the pure color approaches a center of the circular boundary of the HSV color space and the saturation decreases, the saturation may be decreased by increasing values of other channels. The output value may also be shown as being greater than the actual input value by enhancing the value V in a range where the value V is low, and brightness can be increased by adding white from a value where the value V is greater than 1.

Figure 4:
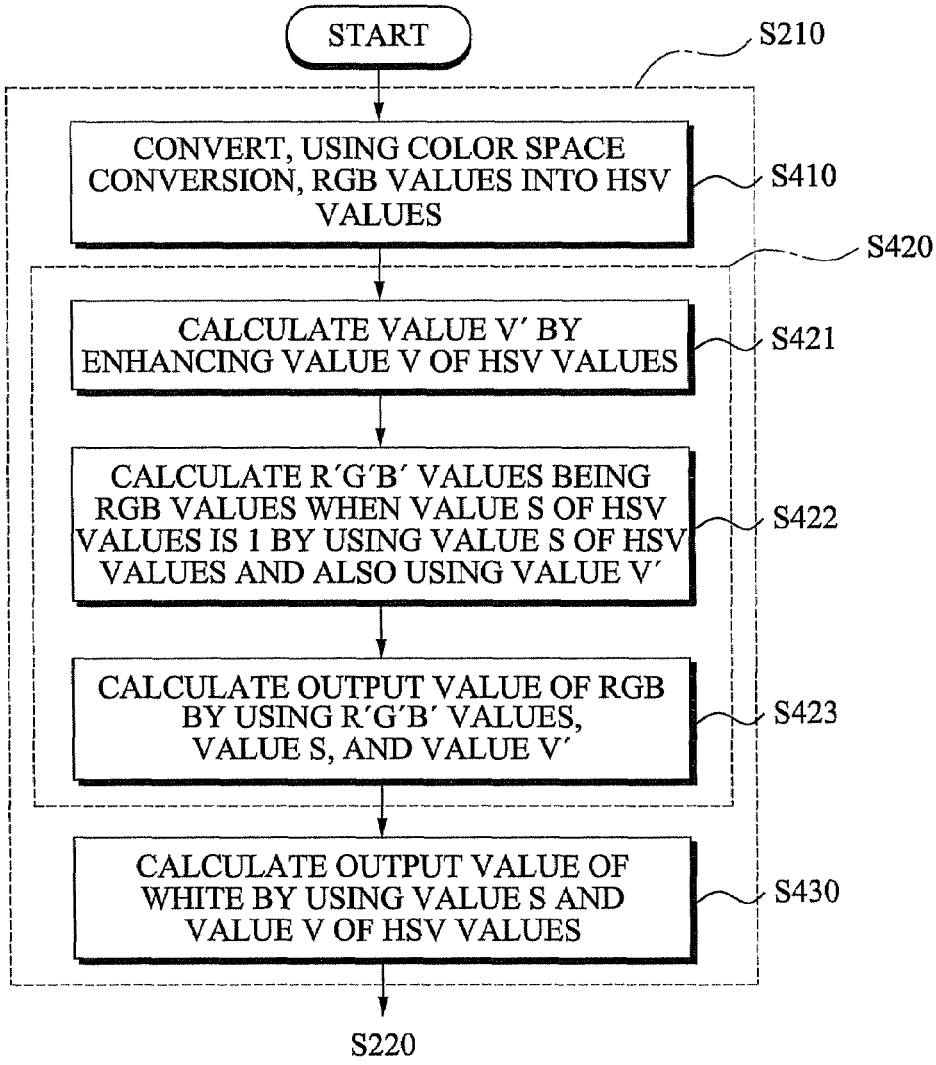
FIG. 4 is a flowchart illustrating an RGB-to-RGBW color decomposition method according to another embodiment of the present invention.

FIGS. 4 through 8 show a process of calculating the output value of white illustrated in FIG. 2 by the method shown in FIG. 3. FIG. 4 is a flowchart of an RGB-to-RGBW color decomposition process according to another embodiment of the present invention. As shown in FIG. 4, operations S410 through S430 can be performed in operation S210 instead of operations S211 through S213 shown in FIG. 2.

In operation S410, the RGB-to-RGBW color decomposition system converts the RGB values into HSV values using a color space conversion. In this instance, the HSV values may be calculated using the above-described Equation 3 and may denote color space values where a circular boundary in an upper side shows a pure color.

In operation S420, the RGB-to-RGBW color decomposition system calculates the output value of the RGB values using the HSV values. In this instance, the RGB-to-RGBW color decomposition system may include operations S421 through S423 in operation S420 in order to calculate the output value of the RGB values as illustrated in FIG. 4.

Figure 5:
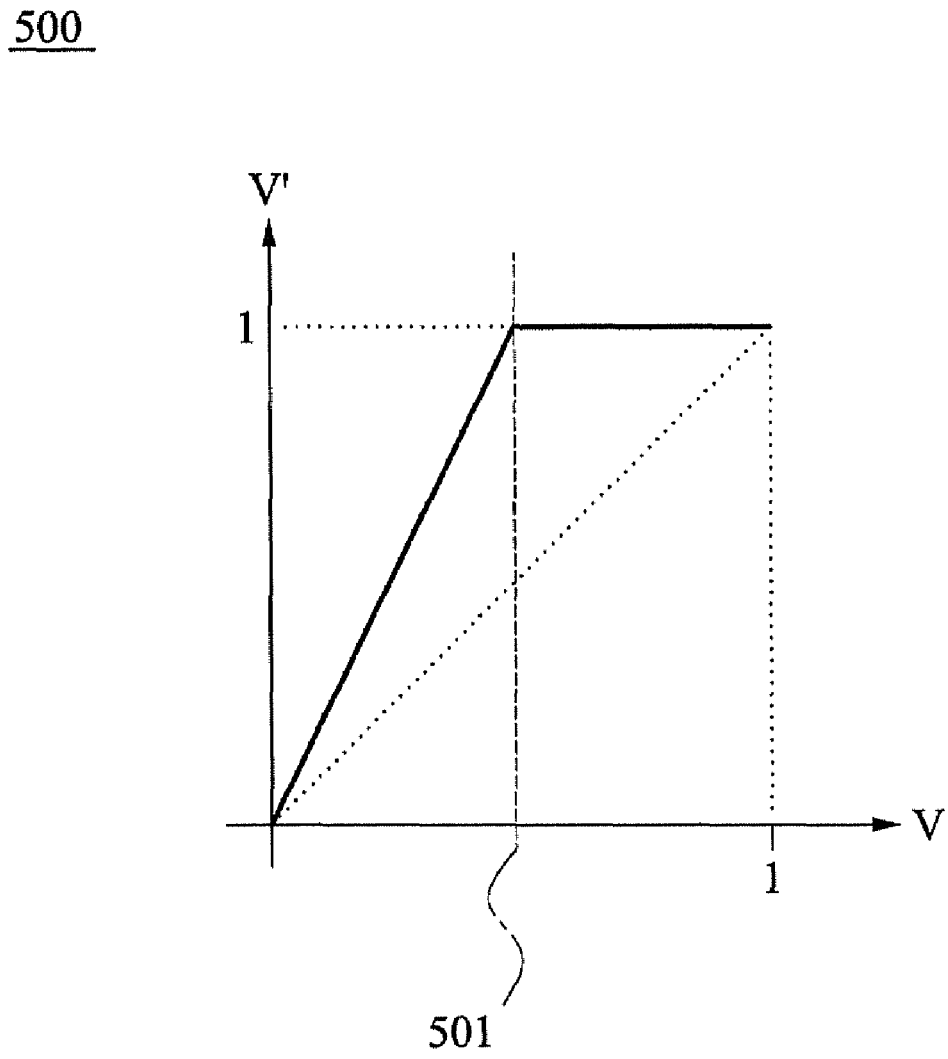
FIG. 5 illustrates a value V enhancement according to an embodiment of the present invention.

In operation S421, the RGB-to-RGBW color decomposition system calculates a value V' by enhancing a value V of the HSV values. For this, the RGB-to-RGBW color decomposition system linearly increases the value V based on an inputted model parameter Vth, and calculates the value V' by clipping the value V at a predetermined maximum value when the value V of the increased values V is greater than the predetermined maximum value. FIG. 5 shows a value V enhancement according to an embodiment of the present invention. As shown in FIG. 5, the maximum value is 1, and the value V may be increased by setting to 1 the values of V that exceed the maximum value 1. Vth 501 is a value of determining a degree of increasing the value V, and may be pre-set or inputted by a user.

In operation S422, the RGB-to-RGBW color decomposition system calculates R'G'B' values, the R'G'B' values being the RGB values when a value S of the HSV values is 1, using the value S of the HSV values and the value V'. For this, the RGB-to-RGBW color decomposition system may acquire, as the R'G'B' values, a value P'(H, 1, V') of a boundary surface location where a value S of a color P(H, S, V') existing in a circle generated in a location of the value V' in the HSV color space shown in FIG. 3, is maximally enhanced.

In operation S423, the RGB-to-RGBW color decomposition system calculates the output value of the RGB using the R'G'B' values, the value S, and the value V'. When the value S is greater than an inputted model parameter Sth for at least one of a value R, a value G, and a value B of the RGB values, the RGB-to-RGBW color decomposition system sets at least one of a value R', a value G', and a value B' of the R'G'B' values to at least one of the output value R, the output value G, and the output value B. When the value S is less than or equal to an inputted model parameter Sth for at least one of a value R, a value G, and a value B of the RGB values, the RGB-to-RGBW color decomposition system increases the output value linearly proportional to the value S. When the value S is 0, the RGB-to-RGBW color decomposition system determines the value V' as at least one of the output value R, the output value G, and the output value B.

Figure 6:
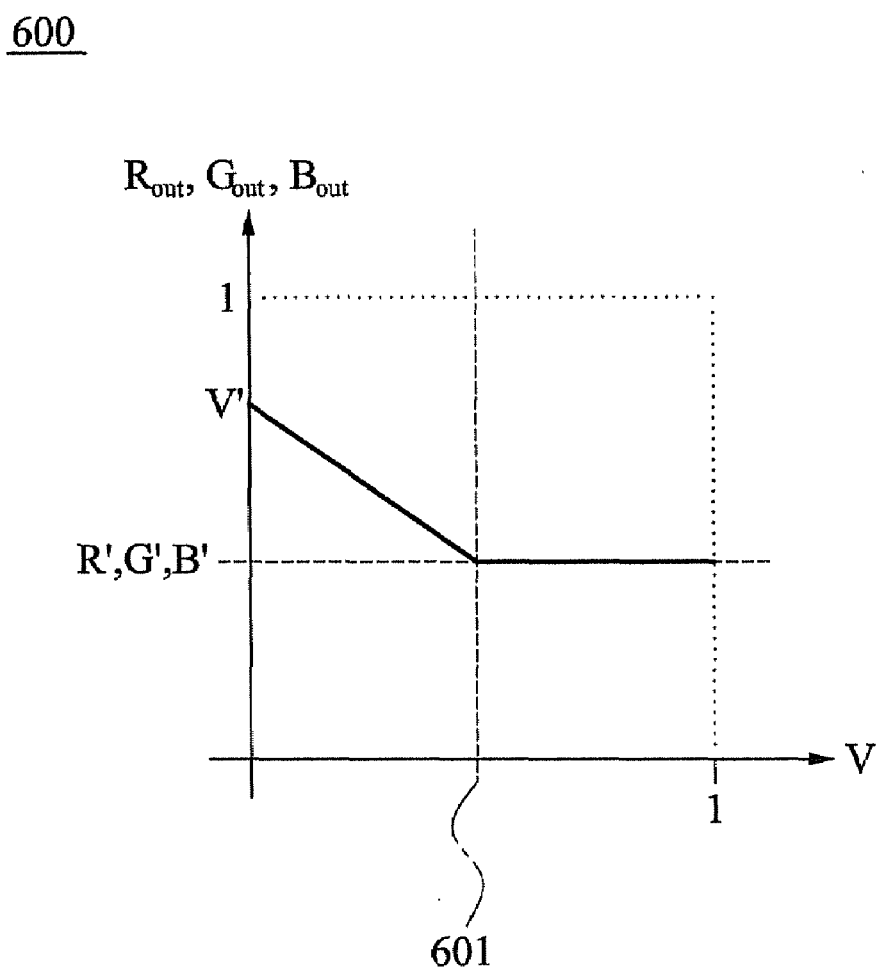
FIG. 6 illustrates a method of calculating an output value of RGB values by using a value S of Hue, Saturation, Value (HSV) values and also using an enhanced value V according to an embodiment of the present invention.

FIG. 6 shows a method of calculating an output value of RGB values using a value S of HSV values and the value V'. When the value S is greater than Sth 601, an output value of R, $R_{out}$, being an output value of R transmits the value R' of the R'G'B' values to $R_{out}$ as is. When the value S is less than Sth 601, $R_{out}$ is linearly increased as S decreases. When the value S is 0, that is, in the case of a neutral color, $R_{out}$ is equal to the value V'. Similar processes may be used with respect to G and $G_{out}$ and B and $B_{out}$.

In operation S430, the RGB-to-RGBW color decomposition system calculates the output value of white using a value S and a value V of the HSV values. In this instance, when the value S of white is greater than 0 and is less than an inputted model parameter Sth, the RGB-to-RGBW color decomposition system determines the value V as the output value. When the value S of white is greater than an inputted model parameter Sth and is less than 1, the RGB-to-RGBW color decomposition system linearly decreases the output value from the value V to a minimum value of the value V.

Figure 7A:
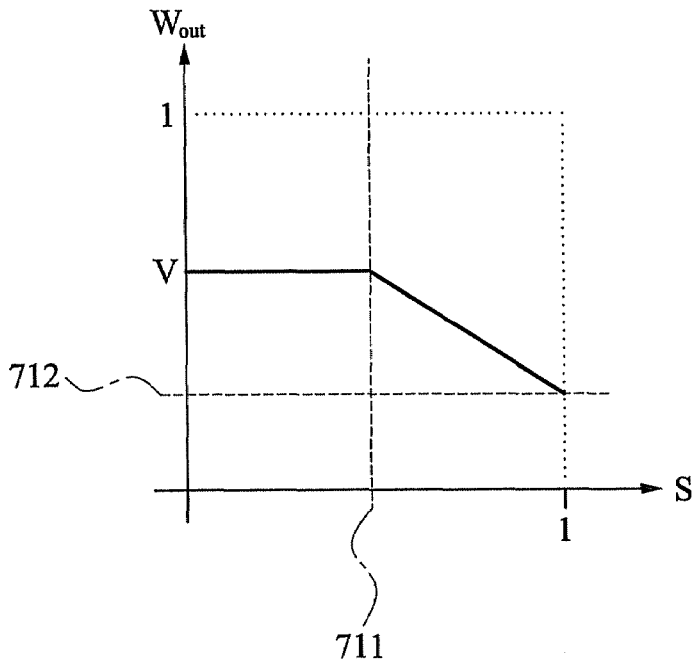
FIGS. 7A and 7B illustrate a method of calculating an output value of white using a value S and a value V of HSV values according to an embodiment of the present invention.
Figure 7B:
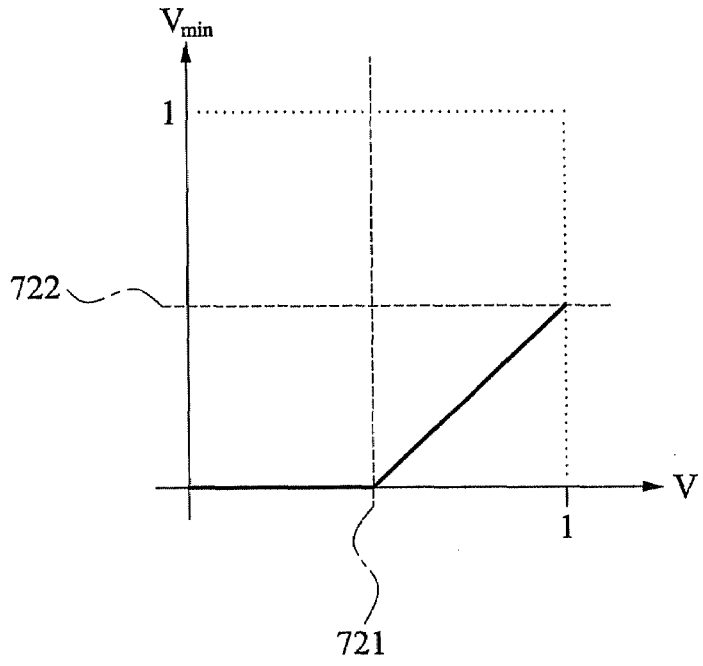

FIGS. 7A and 7B show a process of calculating an output value of white using a value S and a value V of HSV values according to an embodiment of the present invention. As shown in FIGS. 7A and 7B, when the value S is greater than 0 and less than or equal to Sth 711, the output value of white $W_{out}$ may be determined as the value V. When the value S is greater than Sth 711 and is less than 1, $W_{out}$ may linearly decrease from the value V to the minimum value Vmin 712. In this instance, the Vmin 712 is determined by the value V. When the value V is less than or equal to an inputted model parameter Vth 721, the Vmin 712 is 0, and when the value V is greater than the inputted model parameter Vth 721, the Vmin 712 increases to an inputted model parameter value $W_{add}$ 722 when the value V is 1.

Vth, Sth, and $W_{add}$ used for aspects of the present invention are model parameters selected by a user. Vth may denote a location where the value V is enhanced and saturation is performed. $W_{add}$ may denote a degree of adding white to the pure color. Sth is a value denoting a location of decreasing the saturation by using only white, and may be a value equal for all values V or be a function of the value V.

Figure 8:
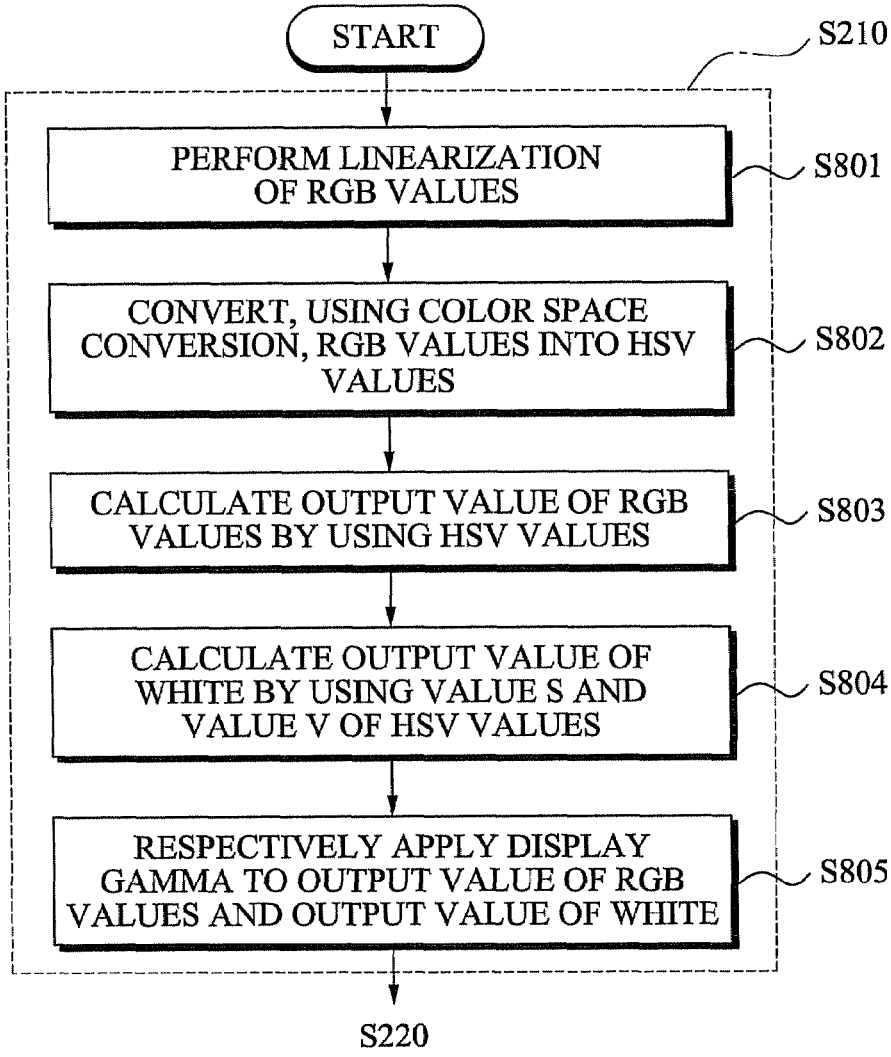
FIG. 8 is a flowchart illustrating an RGB-to-RGBW color decomposition method according to still another embodiment of the present invention.

FIG. 8 is a flowchart of an RGB-to-RGBW color decomposition process according to still another embodiment of the present invention. As shown in FIG. 8, operations S801 through S805 may be performed in operation S210 instead of operations S211 through S213 as shown in FIG. 2. In this instance, operations S802 through S804 may correspond to operations S410 through S430 of FIG. 4. Specifically, the operations illustrated in FIG. 8 may replace or supplement the operations shown in FIG. 4.

In operation S801, the RGB-to-RGBW color decomposition system performs linearization of the RGB values. The linearization of the RGB values may be performed before converting, the RGB values into the HSV values using a color space conversion in operation S802 (corresponding to operation S410 of FIG. 4.) The linearization of the RGB values may denote a process of converting the RGB values into values linear to output brightnesses.

In operation S805, the RGB-to-RGBW color decomposition system applies a display gamma to the output value of the RGB values and the output value of white. The RGB-to-RGBW color decomposition system applies the display gamma to the output value of the RGB values calculated in operation S803 (corresponding to operation S420 of FIG. 4), and the output value of white calculated in operation S804 (corresponding to operation S430). For example, when an input image is a standard RGB (sRGB) image, a gamma value of 2.2 can be applied to the linearized RGB values, similar to $R=(dR/255)^{2.2}$.

Aspects of the present invention negate a problem that when a degree of increasing white is calculated using the HSV values calculated based on digital RGB values, the increased values have a nonlinear relation to a brightness, and the output values are not shown as linearly increasing.

Figure 9:
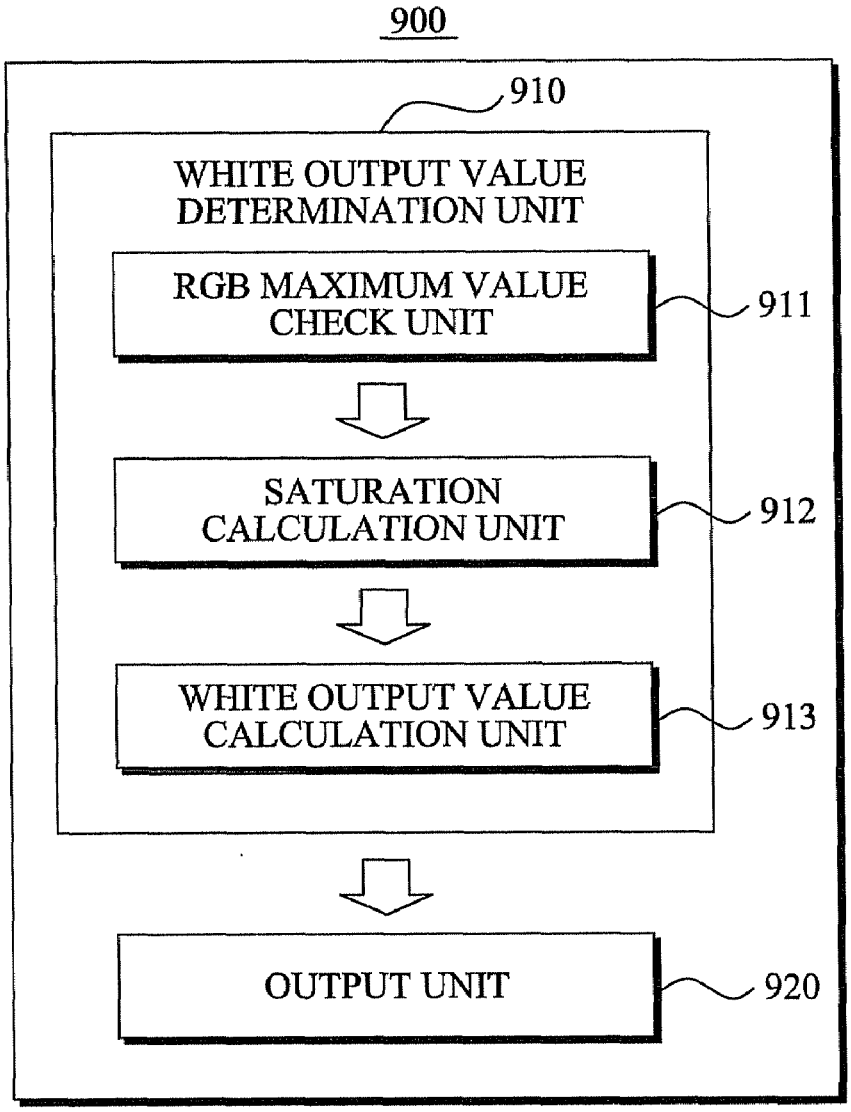
FIG. 9 is a block diagram illustrating an internal configuration of an RGB-to-RGBW color decomposition system according to an embodiment of the present invention.

FIG. 9 is a block diagram of an internal configuration of an RGB-to-RGBW color decomposition system 900 according to an embodiment of the present invention. The RGB-to-RGBW color decomposition system 900 includes a white output value determination unit 910 and an output unit 920. According to other aspects of the present invention, the system 900 may include additional and/or different units. Similarly, the functionality of the above-described units may be combined into a single component.

Figure 10:
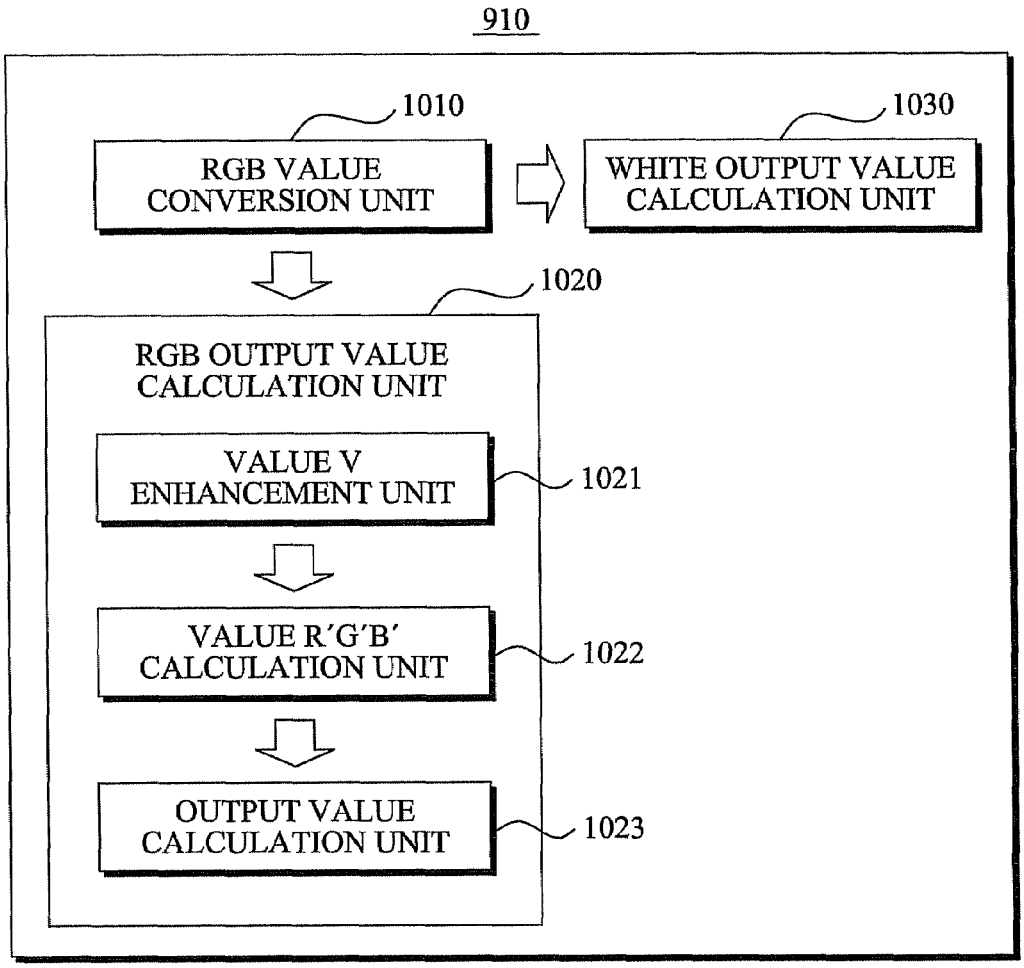
FIG. 10 is a block diagram illustrating another internal configuration of a white output value determination unit according to an embodiment of the present invention.
Figure 11:
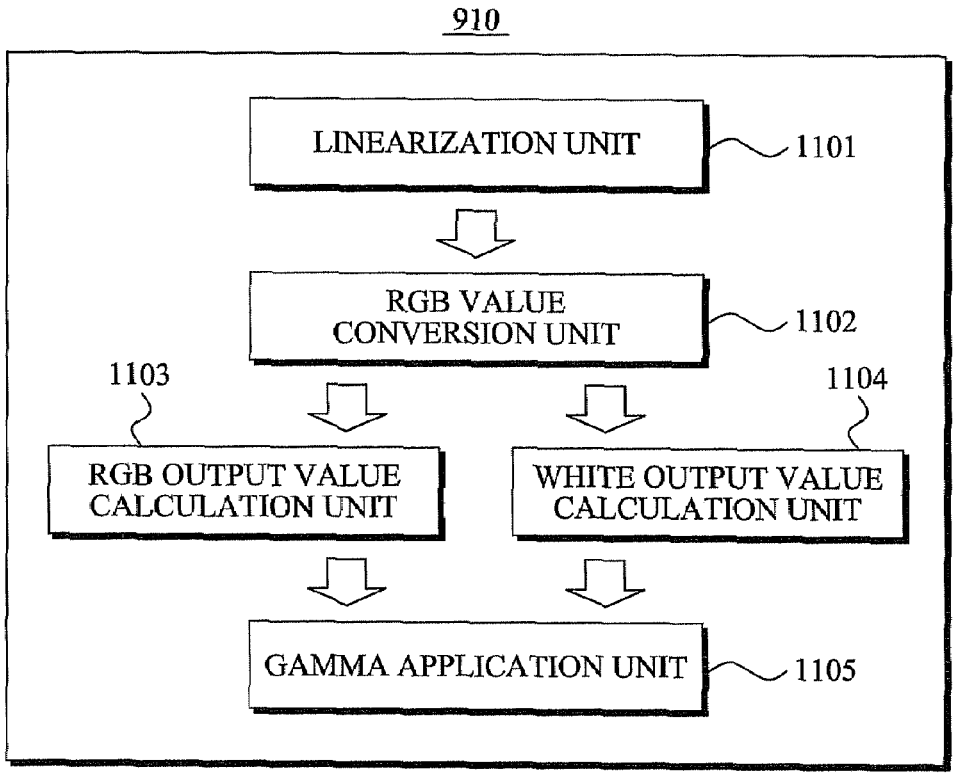
FIG. 11 is a block diagram illustrating still another internal configuration of a white output value determination unit according to an embodiment of the present invention.

The white output value determination unit 910 determines an output value of white based on inputted RGB values and a saturation. The output value of white increases as a maximum value of the RGB values increases and a saturation of an input color decreases. The output value of white may be determined in various ways. Various internal configurations of the RGB-to-RGBW color decomposition system 900 according to various embodiments of the present invention are shown in FIGS. 9 through 11. For any one of the various ways, the white output value determination unit 910 includes an RGB maximum value check unit 911, a saturation calculation unit 912, and a white output value calculation unit 913 as shown in FIG. 9.

The RGB maximum value check unit 911 receives the RGB values and checks the maximum value. The maximum value denotes the maximum value of the RGB values and is shown as $Max(R_{in}, G_{in}, B_{in})$. $R_{in}$ denotes an input value of red, $G_{in}$ denotes an input value of green, and $B_{in}$ denotes an input value of blue.

The saturation calculation unit 912 calculates the saturation based on a minimum value and the maximum value of the RGB values. The saturation may be shown as S, and S may be calculated using the maximum value and the minimum value in accordance with the above-described Equation 1.

The white output value calculation unit 913 calculates the output value of white based on the maximum value and the saturation. The output value of white in accordance with the above-described Equation 2 and the RGBW values including the output value of white may be acquired using the input RGB values and the saturation.

The output unit 920 outputs the output value of white. A process of calculating the output value of white by using a method different from the method illustrated in FIG. 9 is described in detail below with reference to FIG. 10 and FIG. 11.

FIG. 10 is a block diagram of another internal configuration of a white output value determination unit according to an embodiment of the present invention. As shown in FIG. 10, an RGB value conversion unit 1010, an RGB output value calculation unit 1020, and a white output value calculation unit 1030 can be included in the white output value determination unit 910 illustrated in FIG. 9 instead of the RGB maximum value check unit 911, the saturation calculation unit 912, and the white output value calculation unit 913.

The RGB value conversion unit 1010 converts, using a color space conversion, the RGB values into HSV values. The HSV values may be calculated using the above-described Equation 3 and may denote color space values where a circular boundary in an upper side shows a pure color.

The RGB output value calculation unit 1020 calculates the output value of the RGB values using the HSV values. The RGB output value calculation unit 1020 includes a value V enhancement unit 1021, a value R'G'B' calculation unit 1022, and an output value calculation unit 1023 in order to calculate the output value of the RGB values as shown in FIG. 10.

The value V enhancement unit 1021 calculates a value V' by enhancing a value V of the HSV values. The value V enhancement unit 1021 linearly increases the value V based on an inputted model parameter Vth, and calculates the value V' by clipping the value V at a predetermined maximum value, when the value V is greater than the predetermined maximum value. FIG. 5 shows a value V enhancement according to an embodiment of the present invention.

The value R'G'B' calculation unit 1022 calculates R'G'B' values, the R'G'B' values being the RGB values when a value S of the HSV values is 1, using the value S of the HSV values and the value V'. The value R'G'B' calculation unit 1022 can acquire, as the R'G'B' values, a value P'(H, 1, V') of a boundary surface location where a value S of a color P(H, S, V') existing in a circle generated in a location of the value V' in the HSV color space shown in FIG. 3 is maximally enhanced.

The output value calculation unit 1023 calculates the output value of the RGB using the R'G'B' values, the value S, and the value V'. When the value S is greater than an inputted model parameter Sth for at least one of a value R, a value G, and a value B of the RGB values, the output value calculation unit 1023 determines at least one of a value R', a value G', and a value B' of the R'G'B' values as at least one of the value R, the value G, and the value B. When the value S is less than or equal to an inputted model parameter Sth for at least one of a value R, a value G, and a value B of the RGB values, the output value calculation unit 1023 increases the output value linearly proportional to the value S. When the value S is 0, the output value calculation unit 1023 determines the value V' as at least one of the value R, the value G, and the value B.

The white output value calculation unit 1030 calculates the output value of white using a value S and a value V of the HSV values. When the value S of white is greater than 0 and less than an inputted model parameter Sth, the white output value calculation unit 1030 determines the value V as the output value. When the value S of white is greater than an inputted model parameter Sth and is less than 1, the white output value calculation unit 1030 linearly decreases the output value from the value V to a minimum value of the value V. The minimum value is a value determined by the value V. When the value V is less than an inputted model parameter Vth, the minimum value is 0. When the value V is greater than the Vth, the minimum value increases to an inputted model parameter value $W_{add}$ when the value V is 1.

Vth, Sth, and $W_{add}$ used according to aspects of the present invention are model parameters selected by a user. Vth may denote a location where the value V is enhanced and saturation is performed. $W_{add}$ may denote a degree of adding white added to the pure color. Sth is a value denoting a location of decreasing the saturation by using only white and may use a value equal in all values V or may be a function of the value V.

FIG. 11 is a block diagram illustrating still another internal configuration of a white output value determination unit according to an embodiment of the present invention. As shown in FIG. 11, a linearization unit 1101, an RGB value conversion unit 1102, an RGB output value calculation unit 1103, a white output value calculation unit 1104, and a gamma application unit 1105 are be included in the white output value determination unit 910 shown in FIG. 9 instead of the RGB maximum value check unit 911, the saturation calculation unit 912, and the white output value calculation unit 913.

The RGB value conversion unit 1102, the RGB output value calculation unit 1103, and the white output value calculation unit 1104 can respectively correspond to the RGB value conversion unit 1010, the RGB output value calculation unit 1020, and the white output value calculation unit 1030. The white output value determination unit 910 illustrated in FIG. 11 may further include the linearization unit 1101 and the gamma application unit 1105 in addition to, or instead of, the white output value determination unit 910 shown in FIG. 10.

The linearization unit 1101 performs linearization of the RGB values. The linearization unit 1101 performs linearization of the RGB values before the RGB value conversion unit 1102 converts the RGB values into the HSV values using a color space conversion. The linearization of the RGB values may denote a process of converting the RGB values into values linearly proportional to output brightnesses.

The gamma application unit 1105 applies a display gamma to the output value of the RGB values and the output value of white. The gamma application unit 1105 applies the display gamma to the output value of the RGB values calculated by the RGB output value calculation unit 1103 and the output value of white calculated by the white output value calculation unit 1104. For example, when an input image is a standard RGB (sRGB) image, a gamma value of 2.2 can be applied to the linearized RGB values, similar to $R=(dR/255)^{2.2}$.

Aspects of the present invention negate a problem that when a degree of increasing white is calculated using the HSV values calculated based on digital RGB values, the increased values have a nonlinear relation to a brightness and the output values are not shown as linearly increasing.

As described above, when the RGB-to-RGBW color decomposition method and system according to aspects of the present invention is used, an output value of white increases as a maximum value of inputted RGB values increases and a saturation of an input color decreases during a process of converting an RGB input signal into an RGBW output signal. Aspects of the present invention also provide an RGB-to-RGBW color decomposition method and system that can solve a picture quality deterioration problem due to reduction of a brightness ratio of a primary color by adding white to pure colors and increasing the brightness ratio of the primary color to white of a monitor. Aspects of the present invention also provide an RGB-to-RGBW color decomposition method and system that can maximize an effect of increasing a reflectivity of a panel and increasing an output saturation by adding white to a pure color, adding only white to colors in which a saturation decreases from the pure color, increasing digital values of remaining channels after all white is used, and reducing the saturation when the present invention is applied to an RGBW reflection-type display where a partition wall does not exist in a sub-pixel.

Aspects of the present invention may be recorded in computer-readable media including program instructions to implement various operations embodied by a computer. The media may also include, alone or in combination with the program instructions, data files, data structures, and the like. The media and program instructions may be those specially designed and constructed for the purposes of the present invention, or they may be of the kind well-known and available to those having skill in the computer software arts. Examples of computer-readable media include magnetic media such as hard disks, floppy disks, and magnetic tape; optical media such as CD ROM disks and DVD; magneto-optical media such as optical disks; and hardware devices that are specially configured to store and perform program instructions, such as read-only memory (ROM), random access memory (RAM), flash memory, and the like. Examples of program instructions include both machine code, such as produced by a compiler, and files containing higher level code that may be executed by the computer using an interpreter. The described hardware devices may be configured to act as one or more software modules in order to perform the operations of the above-described exemplary embodiments of the present invention.

According to aspects of the present invention, there is provided an RGB-to-RGBW color decomposition method and system in which an output value of white increases as a maximum value of inputted RGB values increases and a saturation of an input color decreases during a process of converting an RGB input signal into an RGBW output signal. Also, according to aspects of the present invention, it is possible to solve a picture quality deterioration problem due to reduction of a brightness ratio of a primary color by adding white to pure colors and increasing the brightness ratio of the primary color to white of a monitor.

According to aspects of the present invention, there is provided an RGB-to-RGBW color decomposition method and system that can maximize an effect of increasing a reflectivity of a panel and increasing an output saturation by adding white to a pure color, adding only white to colors in which a saturation decreases from the pure color, increasing digital values of remaining channels after all white is used, and reducing the saturation when the present invention is applied to an RGBW reflection-type display where a partition wall does not exist in a sub-pixel.

Although a few embodiments of the present invention have been shown and described, it would be appreciated by those skilled in the art that changes may be made in this embodiment without departing from the principles and spirit of the invention, the scope of which is defined in the claims and their equivalents.

What is claimed is:

1. A Red Green Blue-to-Red Green Blue White (RGB-to-RGBW) color decomposition method, the method comprising:

determining, using a computer, an output value of white corresponding to a RGBW output signal, based on inputted RGB values and a saturation of the inputted RGB values; and outputting the output value.

2. The method of claim 1, wherein the output value of white increases as a maximum value of the RGB values increases and a saturation of an input color decreases.

3. The method of claim 1, wherein the determining of the output value comprises:

receiving the RGB values and determining a maximum value of the RGB values;

calculating the saturation based on the RGB values; and calculating the output value of white based on the maximum value and the saturation.

4. The method of claim 3, wherein the calculating of the output value of white calculates the output value of white using Equation 4:

$$R_{out}=R_{in},$$

$$G_{out}=G_{in},$$

$$B_{out}=B_{in},$$

$$W_{out}=\{(1-S)(1-\alpha)+\alpha\}*\mathrm{Max}(R_{in},G_{in},B_{in}), \quad \text{[Equation 4]}$$

where Rh denotes an input value of red, $G_{in}$ denotes an input value of green, $B_{in}$ denotes an input value of blue, $R_{out}$ denotes an output value of red, $G_{out}$ denotes an output value of green, $B_{out}$ denotes an output value of blue, $W_{out}$ denotes an output value of white, S denotes a saturation, $\mathrm{Max}(R_{in}, G_{in}, B_{in})$ denotes a maximum value of the RGB values, and a denotes a value between 0 and 1.

5. The method of claim 1, wherein the calculating of the output value of white comprises:

converting the RGB values into color space values including a brightness and a saturation component using a color space conversion;

calculating the output value of the RGB values using the color space values; and calculating the output value of white using a value S and a value V of the color space values.

6. The method of claim 5, wherein the calculating of the output value of the RGB values comprises:

calculating a value V' by enhancing a brightness value V of the color space values including the brightness and the saturation component;

calculating R'G'B' values, the R'G'B' values being the RGB values when a value S of the color space values including the brightness and the saturation component is maximum, using the saturation value S and the value V'; and calculating the output value of the RGB using the R'G'B' values, the value S, and the value V'.

7. The method of claim 6, wherein the calculating of the value V' comprises:

linearly increasing the value V based on an inputted model parameter Vth; and calculating the value V' by clipping the value V at a predetermined maximum value when the value V is greater than the predetermined maximum value.

8. The method of claim 6, wherein, when the value S is greater than an inputted model parameter Sth for at least one of a value R, a value G, and a value B of the RGB values, the calculating of the output value of the RGB comprises determining at least one of a value R', a value G', and a value B' of the R'G'B' values to be at least one of the value R, the value G, and the value B.

9. The method of claim 6, wherein:

when the value S is less than or equal to an inputted model parameter Sth for at least one of a value R, a value G, and a value B of the RGB values, the calculating of the output value of the RGB comprises increasing the output value linearly proportional to the value S; and when the value S is 0, the calculating of the output value of the RGB comprises determining the value V' as at least one of the value R, the value G, and the value B.

10. The method of claim 5, wherein, when the value S of white is greater than 0 and is less than an inputted model parameter Sth, the calculating of the output value of white comprises determining the value V as the output value.

11. The method of claim 5, wherein, when the value S of white is greater than an inputted model parameter Sth and is less than 1, the calculating of the output value of white comprises linearly decreasing the output value from the value V to a minimum value of the value V.

12. The method of claim 11, wherein:

the minimum value is a value determined by the value V; and when the value V is less than or equal to an inputted model parameter Vth, the minimum value is 0, and when the value V is greater than the inputted model parameter Vth, the minimum value increases to a maximum value of an inputted model parameter value $W_{add}$ when the value V is 1.

13. The method of claim 5, wherein the calculating of the output value of white further comprises:

performing linearization of the RGB values; and applying a display gamma to the output value of the RGB values and the output value of white.

14. A Red Green Blue-to-Red Green Blue White (RGB-to-RGBW) color decomposition method, the method comprising:

receiving inputted RGB values and determining a maximum value of the RGB values;

calculating, using a computer, a saturation based on the RGB values; and calculating an output value of white corresponding to a RGBW output signal, based on the maximum value and the saturation.

15. The method of claim 14, wherein the calculating of the output value of white comprises calculating the output value of white using Equation 5:

$$R_{out}=R_{in},$$

$$G_{out}=G_{in},$$

$$B_{out}=B_{in},$$

$$W_{out}=\{(1-S)(1-\alpha)+\alpha\}*\mathrm{Max}(R_{in},G_{in},B_{in}), \quad \text{[Equation 5]}$$

where $R_{in}$ denotes an input value of red, $G_{in}$ denotes an input value of green, $B_{in}$ denotes an input value of blue, $R_{out}$ denotes an output value of red, $G_{out}$ denotes an output value of green, $B_{out}$ denotes an output value of blue, $W_{out}$ denotes an output value of white, S denotes a saturation, $\mathrm{Max}(R_{in}, G_{in}, B_{in})$ denotes a maximum value of the RGB values, $\mathrm{Min}(R_{in}, G_{in}, B_{in})$ denotes a minimum value of the RGB values, and a denotes a value between 0 and 1.

16. A Red Green Blue-to-Red Green Blue White (RGB-to-RGBW) color decomposition method comprising:

converting RGB values into color space values including a brightness and a saturation component using a color space conversion; and calculating, using a computer, an output value of white corresponding to a RGBW output signal, using a saturation value S and a brightness value V of the color space values.

17. The method of claim 16, further comprising:

calculating an output value of the RGB values using the color space values.

18. The method of claim 16, wherein the calculating of the output value of the RGB values comprises:

calculating a value V' by enhancing a value V of the color space values;

calculating R'G'B' values, the R'G'B' values being the RGB values when a value S of the color space values is maximum, by using the value S and the value V'; and calculating the output value of the RGB using the R'G'B' values, the value S, and the value V'.

19. The method of claim 18, wherein the calculating of the value V' comprises:

linearly increasing the value V based on an inputted model parameter Vth; and calculating the value V' by clipping the value V at a predetermined maximum value when the value V is greater than the predetermined maximum value.

20. The method of claim 18, wherein, when the value S is greater than an inputted model parameter Sth for at least one of a value R, a value G, and a value B of the RGB values, the calculating of the output value of the RGB comprises determining at least one of a value R', a value G', and a value B' of the R'G'B' values as at least one of the value R, the value G, and the value B.

21. The method of claim 18, wherein:

when the value S is less than or equal to an inputted model parameter Sth for at least one of a value R, a value G, and a value B of the RGB values, the calculating of the output value of the RGB comprises increasing the output value linearly proportional to the value S, and when the value S is 0, the calculating of the output value of the RGB comprises determining the value V' as at least one of the value R, the value G, and the value B.

22. The method of claim 16, wherein, when the value S of white is greater than 0 and is less than an inputted model parameter Sth, the calculating of the output value of white comprises determining the value V as the output value, and when the value S of white is greater than an inputted model parameter Sth and is less than 1, the calculating of the output value of white comprises linearly decreasing the output value from the value V to a minimum value of the value V.

23. The method of claim 22, wherein:

the minimum value is a value determined by the value V; and when the value V is less than or equal to an inputted model parameter Vth, the minimum value is 0, and when the value V is greater than the inputted model parameter Vth, the minimum value increases to an inputted model parameter value $W_{add}$ when the value V is 1.

24. The method of claim 16, further comprising:

performing linearization of the RGB values; and applying a display gamma to the output value of the RGB values and the output value of white.

25. A non-transitory computer-readable recording medium storing a program to implement a Red Green Blue-to-Red Green Blue White (RGB-to-RGBW) color decomposition method, the method comprising:

determining an output value of white corresponding to a RGBW output signal, based on inputted RGB values and a saturation; and outputting the output value.

26. A Red Green Blue-to-Red Green Blue White (RGB-to-RGBW) color decomposition system comprising:

a white output value determination unit to determine an output value of white based on inputted RGB values and a saturation of the inputted RGB values; and an output unit to output the output value when an input color is a pure color.

27. The system of claim 26, wherein the output value of white increases as a maximum value of the RGB values increases and a saturation of an input color decreases.

28. The system of claim 26, wherein the white output value determination unit comprises:

an RGB maximum value check unit to receive the RGB values and to check the maximum value;

a saturation calculation unit to calculate the saturation based on the RGB values; and a white output value calculation unit to calculate the output value of white based on the maximum value and the saturation.

29. The system of claim 26, wherein the white output value determination unit comprises:

an RGB value conversion unit to convert the RGB values into color space values including a brightness and a saturation component using a color space conversion;

an RGB output value calculation unit to calculate the output value of the RGB values using the color space values; and a white output value calculation unit to calculate the output value of white using a saturation value S and a brightness value V of the color space values.

30. A Red Green Blue-to-Red Green Blue White (RGB-to-RGBW) color decomposition system comprising:

an RGB maximum value check unit to receive inputted RGB values and to check a maximum value;

a saturation calculation unit to calculate a saturation based on the RGB values; and a white output value calculation unit to calculate an output value of white based on the maximum value and the saturation.

31. The system of claim 30, wherein the white output value calculation unit calculates the output value of white using Equation 6:

$$R_{out}=R_{in},$$

$$G_{out}=G_{in},$$

$$B_{out}=B_{in},$$

$$W_{out}=\{(1-S)(1-\alpha)+\alpha\}*\mathrm{Max}(R_{in},G_{in},B_{in}), \quad \text{[Equation 6]}$$

where $R_{in}$ denotes an input value of red, $G_{in}$ denotes an input value of green, $B_{in}$ denotes an input value of blue, $R_{out}$ denotes an output value of red, $G_{out}$ denotes an output value of green, $B_{out}$ denotes an output value of blue, $W_{out}$ denotes an output value of white, S denotes a saturation, $\mathrm{Max}(R_{in}, G_{in}, B_{in})$ denotes a maximum value of the RGB values, and a denotes a value between 0 and 1.

32. A Red Green Blue-to-Red Green Blue White (RGB-to-RGBW) color decomposition system, the system comprising:

an RGB conversion unit to convert the RGB values into color space values including a brightness and a saturation component using a color space conversion; and a white output value calculation unit to calculate the output value of white corresponding to a RGBW output signal, using a saturation value S and a brightness value V of the color space values.

33. The system of claim 32, further comprising:

an RGB output value calculation unit to calculate the output value of the RGB values using the color space values including the brightness and the saturation component.

34. The system of claim 33, wherein the RGB output value calculation unit comprises:

a V enhancement unit to calculate a value V' by enhancing a value V of the color space values including the brightness and the saturation component;

a R'G'B' calculation unit to calculate R'G'B' values, the R'G'B' values being the RGB values when the value S is maximum using the value S and the value V'; and an output value calculation unit to calculate the output value of the RGB using the R'G'B' values, the value S, and the value V'.

35. The system of claim 32, wherein:

when the value S of white is greater than 0 and is less than an inputted model parameter Sth, the white output value calculation unit determines the value V as the output value; and when the value S of white is greater than an inputted model parameter Sth and is less than 1, the white output value calculation unit linearly decreases the output value from the value V to a minimum value of the value V.

36. The system of claim 32, further comprising:

a linearization unit to perform linearization of the RGB values; and a gamma application unit to apply a display gamma to the output value of the RGB values and the output value of white.

37. A system to convert from RGB (Red-Green-Blue) to RGBW (Red-Green-Blue-White) without negatively impacting a brightness, the system comprising:

a white value determining unit to determine a white value corresponding to a RGBW output signal and an output RGB value based on an input RGB value such that the white value increases linearly as the output RGB value increases; and an output unit to output the white value and the RGB value corresponding to a pixel to be displayed on a display.

38. The system of claim 37, wherein the white value determining unit comprises:

a maximum value determination unit to determine a maximum value of the input RGB values;

a saturation calculation unit to calculate a saturation based on the maximum value; and a white value calculation unit to determine the white value based on the maximum value and the saturation.

39. The system of claim 37, wherein the white value determining unit comprises:

an RGB conversion unit to convert the RGB values into HSB (hue-saturation-brightness) values;

an RGB value calculation unit to determine the output RGB values based on the HSB values; and a white value calculation unit to determine the white value based on the HSB values.

40. The system of claim 39, wherein the RGB value calculation unit comprises:

a brightness enhancement unit to enhance a brightness value of the HSB values;

an RGB determination unit to determine intermediate RGB values based on the enhanced brightness value and a saturation value of the HSB values; and an RGB output unit to determine the output RGB values based on the intermediate RGB values, the enhanced brightness value, and the saturation value.

41. The system of claim 39, wherein the white value determining unit further comprises:

a linearization unit to linearize the input RGB values such that the linearized RGB values are linearly proportional to brightness; and a gamma unit to apply a gamma to the output RGB values and the white values;

wherein the RGB conversion unit converts the linearized RGB values into the HSB values.

42. The system of claim 37, wherein the white determining unit determines the white value such that the white value increases as a maximum value of the input RGB value increases and a saturation of the input RGB value decreases.

43. The system of claim 37, wherein the white determining unit only determines the white value, without adjusting the input RGB values.

* * * * *

UNITED STATES PATENT AND TRADEMARK OFFICE

CERTIFICATE OF CORRECTION

PATENT NO. : 8,049,763 B2
APPLICATION NO. : 12/017395
DATED : November 1, 2011
INVENTOR(S) : Young Shin Kwak et al.

It is certified that error appears in the above-identified patent and that said Letters Patent is hereby corrected as shown below:

Column 11, Line 60, In Claim 4, delete "Rh" and insert -- $R_{in}$ --, therefor.

Column 11, Line 66, In Claim 4, delete "a" and insert -- α --, therefor.

Column 13, Line 31, In Claim 15, delete "a" and insert -- α --, therefor.

Column 15, Line 26, In Claim 31, delete "a" and insert -- α --, therefor.

Signed and Sealed this
Fourteenth Day of February, 2012

David J. Kappos

David J. Kappos
*Director of the United States Patent and Trademark Office*